United States Patent [19]

Cole et al.

[11] 4,104,035

[45] Aug. 1, 1978

[54] PREPARATION OF SOLID FUEL-WATER SLURRIES

[75] Inventors: Edward L. Cole, Fishkill; Howard V. Hess, Glenham; Frank E. Guptill, Jr., Fishkill, all of N.Y.

[73] Assignee: Texaco Inc., New York, N.Y.

[21] Appl. No.: 639,730

[22] Filed: Dec. 11, 1975

[51] Int. Cl.[2] ..... C10L 1/32

[52] U.S. Cl. ..... 44/51; 252/311.5; 302/66

[58] Field of Search ..... 44/51, 1 R; 302/66; 252/311.5

[56] References Cited

U.S. PATENT DOCUMENTS

| | | | |
|---|---|---|---|
| 1,390,230 | 9/1921 | Bates | 44/51 |
| 2,131,308 | 9/1938 | Blumner | 44/51 |
| 2,359,325 | 10/1944 | McConnell | 44/51 X |
| 3,660,054 | 5/1972 | Rieve | 44/1 R |
| 3,762,887 | 10/1973 | Clancey et al. | 44/51 |
| 3,907,134 | 9/1975 | Metzger | 44/51 |
| 3,996,026 | 12/1976 | Cole | 44/51 X |

*Primary Examiner*—Daniel E. Wyman
*Assistant Examiner*—Thomas A. Waltz
*Attorney, Agent, or Firm*—Thomas H. Whaley; Carl G. Ries; Robert Knox, Jr.

[57] ABSTRACT

Preparation of a solid fuel-water slurry suitable for use as feed to a partial oxidation zone for the production of synthesis gas by forming a mixture of finely-divided solid fuel and water, heating the mixture to a temperature above 300° F. under pressure sufficient to maintain water in the liquid phase, cooling the mixture and adding a surface active agent and sufficient water to form a mixture having a water content between 40 and 50 weight %.

16 Claims, No Drawings

PREPARATION OF SOLID FUEL-WATER SLURRIES

This invention relates to the production of solid fuel-water slurries. More particularly, it is concerned with the production of slurries of solid fuel in water, suitable for feed to a generator for gasification of the solid fuel by partial oxidation.

The gasification of solid fuels such as coal is well known. Several methods have been proposed for such a procedure. In one method the solid fuel is ground to a fine powder and fed to the gas generator as a suspension in a vaporous medium e.g., steam or in a gaseous medium such as a free oxygen-containing gas. However, this method is unsatisfactory as it is difficult to control the amount and rate of solid fuel fed to the gas generator. In addition, if the solid fuel is suspended in a free oxygen-containing gas, care must be taken to maintain the velocity of the suspension above the rate of flame propagation to avoid a backflash which to say the least, is undesirable.

It has also been proposed to feed a powdered solid fuel such as coal into a gasification reactor suspended in liquid such as water. This too, has not been satisfactory as the fuel should be in the form of a pumpable slurry. Ordinarily a pumpable slurry of solid fuel or coal requires the addition of water to the powdered fuel to form a slurry containing not more than about from 40 to 45 wt. % solids. As the solids content increases above this range the slurry becomes increasingly difficult to pump and at about 50% solids content, it is unpumpable. Actually such slurries contain in excess of 50% water as there is a considerable amount of water in coal as mined such as occasional water or surface water which may be easily removed by heating the coal or solid fuel to a temperature just above 100° C., and occluded water, which is found in the smaller pores and requires additional heating for removal. The coal or solid fuel also contains chemically bound water. This water is present in the coal as mined and plays no part in the pumpability of the slurry so that depending on the type of solid fuel, a pumpable slurry may contain as little as about 30 to 35 wt. % solids on a dry basis. Such a coal-water slurry is not a satisfactory feed for a gas generator as the large volume of water present in the slurry moderates the temperature of the gasification zone to such an extent that the reaction temperature is too low for satisfactory operation.

It is therefore an object of this invention to produce solid fuel-water slurries having a high solids content. Another object is to form coal water-slurries suitable for use as feed to a gas generator. These and other objects will be obvious to those skilled in the art from the following disclosure.

According to our invention there is provided a process for the gasification of a solid fuel which comprises forming a mixture of a finely-divided solid fuel and water, heating the resulting mixture under pressure sufficient to maintain the water in liquid phase, cooling the mixture, forming the so-treated solid fuel into a water-solid fuel slurry having a solids content between about 50 and 60 wt. % on a dry basis, adding a surface active agent to said slurry in an amount to form a pumpable slurry, and introducing the slurry into a gasification zone.

The process of our invention may be applied to any solid fuel such as coal or coke and the like but it is particularly adapted to sub-bituminous coal and lignite which contain relatively large amounts of water as mined. Suitably the solid fuel is ground so that at least 70% passes through a 200 mesh sieve and preferably at least 70% passes through a 325 mesh sieve (U.S.A. Standard Series).

The hydrothermal treatment as practiced in the process of our invention may be effected under either static or dynamic conditions. In one embodiment of our invention the slurry of solid fuel in water containing from about 1 to 3 parts water by weight is introduced into a pressure vessel such as an autoclave. Since the hydrothermal treatment is effected under non-oxidizing conditions, advantageously the pressure vessel is swept with an inert gas or hydrogen prior to the introduction of the slurry. In the alternative, the slurry is introduced into the vessel which may then be swept with hydrogen or with an inert gas and then hydrogen. After removal of the oxygen-containing gases, the vessel is pressured with hydrogen or an inert gas such as nitrogen and then heated under autogenous pressure to a temperature between about 300° and 700° F. preferably between 400° and 600° F., the pressure being such that water in liquid state is maintained in the reaction vessel. After a period of time between about one minute and two hours the vessel is vented and the slurry removed therefrom. Although some reaction is obtained at short time intervals of less than five minutes, for practical reasons, it is more desirable to maintain the reactants at the designated temperature for a period of at least five minutes.

In another embodiment of our invention the solid fuel-water slurry is passed under conditions of turbulent flow through an elongated tubular reaction zone in the presence of added hydrogen and in the substantial absence of oxygen-containing gases. This may be done, for example, by introducing the slurry from the bottom of a slurrying vessel through a compressor into the tubular reaction zone. The slurry is passed through the tubular reaction zone under turbulent flow conditions at a temperature between about 300° and 700° F., preferably between 400° and 600° F. under a pressure sufficient to maintain liquid water in the reaction zone. In a more specific embodiment, the solid fuel-water slurry may be subjected to an initial hydrothermal treatment in the absence of hydrogen and oxygen-containing gases in a procedure in which any gaseous medium present is an inert gas such as nitrogen. The pressure is then released after a period of between about one minute and two hours at reaction conditions of temperature and pressure. Volatile material is vented from the system and the slurry pressured with hydrogen and subjected to a second hydrothermal treatment, this time in the presence of added hydrogen.

If hydrogen is used in the process of our invention it need not necessarily be pure but should have a purity of at least about 50 volume percent. Catalytic reformer by-product hydrogen, electrolytic hydrogen, synthesis gas per se produced by the partial oxidation of a carbonaceous or hydrocarbonaceous material and hydrogen produced by the shift conversion of synthesis gas followed by $CO_2$ removal may be used. However, as mentioned above, the hydrothermal treatment is carried out under non-oxidizing conditions and it is not necessary to use hydrogen. The hydrothermal treatment is equally effective when the non-oxidizing sweep or pressuring gas is an inert gas such as nitrogen.

In another embodiment of our invention, a low grade fuel such as sub-bituminous coal or lignite is air dried to a moisture content of below about 20 wt. %. The drying is desirable as, when an attempt is made to grind the low grade fuel as mined, it forms a pasty mass. After drying, the low grade fuel is ground so that at least 70% by weight passes through a 200 mesh screen. The fuel is then formed into a slurry containing 1 to 3 parts by weight water per part of fuel measured on a dry basis. The slurry is introduced into an autoclave which is then swept with nitrogen, sealed and pressured with nitrogen and then heated under autogenous pressure to a temperature not greater than about 600° F. and held at that temperature for a period of time between about fifteen minutes and one hour. The system is then vented for the release of nitrogen and a gas composed primarily of $CO_2$ which is generated during the hydrothermal treatment. The solid fuel is then separated from the water, washed and formed into a slurry containing between about 50 and 60 wt. % fuel measured on a dry basis, a minor amount up to about 3.0 wt. % of a surface active agent and the balance water.

While any surface active agent may be used in the process of our invention, it has been found that anionic surface active agents comprising an alkali metal or alkaline earth metal salt of an organic sulfonic acid are superior, for the purposes of our invention, to other types of surface active agents. Examples of particularly suitable surface active agents are the calcium, sodium and ammonium salts of organic sulfonic acids such as 2,6-dihydroxy naphthalene sulfonic acid and lignin sulfonic acid. In this connection, ammonia is considered as an alkali metal. The surface active agent may be present in the slurry in an amount between about 0.01 and 3.0 wt. %, a preferred amount being between 0.1 and 2.0 wt. %.

After the pressurized-hot water or hydrothermal treatment, the slurry is cooled, the pressure released and the solid fuel separated from the slurry water, washed and reslurried with fresh water in an amount to form a mixture containing from between about 50 and 60 wt. % solids measured on a dry basis. Sufficient surface active agent is then added to confer pumpability to the slurry.

In the alternative, the solid fuel as mined may be mixed with sufficient water to form a mixture containing about 60–80 wt. % water, the mixture introduced into a mill or grinder where the solid fuel is ground so that at least 70% passes through a 200 mesh sieve. The slurry is then passed through a hydrothermal treating coil and then to a separator where the gases formed during the hydrothermal treatment are vented. The slurry is then mixed with the surface active agent, fed to a separator where the water content is reduced to less than 50% and then introduced into the gasifier.

Experimental data show that:

(1) The raw lignite requires over 60 percent water (dry coal basis) to form a pumpable slurry.

(2) the use of surfactive agents was not effective with the raw lignite in lowering the water requirements for the formation of a pumpable slurry.

(3) Hydrothermal treatment of the raw lignite was only moderately effective in lowering the water requirements for forming a pumpable slurry.

(4) However, by the use of a surface active agent following the hydrothermal treatment, water requirements for forming a pumpable slurry were reduced to a significant degree. This was quite unexpected in view of the experiences encountered under items (2) and (3).

The following examples are submitted for illustrative purposes only and it should not be construed that the invention is restricted thereto.

EXAMPLE I

In this example the solid fuel is Alabama lignite having the following analyses:

| | As Received | Dry Basis |
|---|---|---|
| Proximate Analysis | | |
| Moisture, % | 47.3 | — |
| Ash, % | 6.2 | 11.8 |
| Volatile Matter, % | 23.7 | 44.9 |
| Fixed Carbon, % | 22.8 | 43.3 |
| Ultimate Analysis | | |
| Moisture, % | 47.3 | — |
| Ash, % | 6.2 | 11.8 |
| Carbon, % | 33.3 | 63.2 |
| Hydrogen, % | 2.6 | 4.9 |
| Nitrogen, % | 0.6 | 1.1 |
| Sulfur, % | 1.8 | 3.4 |
| Oxygen, % | 8.2 | 15.8 |
| Heating Value | | |
| Gross, Btu/lb. | 5,949 | 11,276 |
| Net, Btu/lb. | 5,670 | 10,747 |

The lignite as received, 223 grams, was ground and while grinding water was added to give a mix having 54.5 percent water. The sample was a heavy sticky paste that was removed from the grinder and placed in a beaker. An additional 50 grams of water was added while mixing with a spatula. The mix was a thick paste, 62 percent water, that had thixotropic properties and was not pumpable. The use of a surface active agent, a sodium lignin sulfonate was not effective in giving a pumpable slurry having less than 60 percent water.

EXAMPLE II

In this example, the charge material is the Alabama lignite used in Example I. 485.5 grams of the lignite was vacuum-dried under a slow stream of nitrogen to a moisture content of 15.2 wt. % and then ball-milled until 79% passed through a 60 mesh sieve. The slurry characteristics were then determined. The technique was to add gradually with stirring to the powdered lignite, water or a water solution of a surface active agent in increments. The mixture passed first through, in the initial stages, a gummy mass which on further addition of liquid with stirring disappeared rather sharply and this point was considered the end point. In each of the following runs 5 grams of the charge was used. The results including the amount of liquid necessary to convert the powdered lignite into a pumpable slurry are shown below in Table 1.

TABLE 1

| Run No. | 1 | 2 | 3 | 4 | 5 |
|---|---|---|---|---|---|
| Lignite, g | 5.0 | 5.0 | 5.0 | 5.0 | 5.0 |
| $H_2O$ added, g. | 4.05 | — | — | — | 4.21 |
| Solution added, g. | — | 3.96* | 3.73# | 3.82# | — |
| Moisture in slurry, wt. % | 53.0 | 52.5 | 51.5 | 51.9 | 53.8 |

*2 wt. % calcium lignin sulfonate
#2 wt. % sodium lignin sulfonate

It will be noted that in Runs 1 and 5 the average moisture content of the slurry was 53.4 wt. % and that in Runs 2, 3 and 4 where a wetting agent was added, the average moisture content was 52.0 wt. %, a reduction of only 2.6%.

EXAMPLE III 300 grams of the same lignite as used in Example I was placed in an autoclave with 600 ml. of water. The autoclave was flushed with nitrogen, sealed and heated to 550° F. and held at that temperature for 35 minutes. A pressure of 1200 psig was noted. The autoclave was then cooled, vented, the lignite recovered, filtered, dried in a vacuum oven flushed with nitrogen to a moisture content of 1.3 wt. % and then ball-milled to less than 60 mesh. The slurry characteristics were determined using the same technique as in Example II. Data are reported below in Table 2.

TABLE 2

| Run No. | 1 | 2 | 3 | 4 | 5 |
|---|---|---|---|---|---|
| Lignite, g. | 5.0 | 5.0 | 5.0 | 5.0 | 5.0 |
| $H_2O$ added, g. | 5.84 | — | — | 5.06 | — |
| Solution added, g. | — | 3.97* | 4.14# | — | 3.75* |
| Moisture in slurry, wt. % | 54.4 | 45.0 | 46.0 | 51.0 | 43.5 |

*2 wt. % sodium lignin sulfonate
#2 wt. % calcium lignin sulfonate

The above data show the improvement resulting from the process of the present invention in which the slurry is formed using lignite which has been hydrothermally treated and also using a surface active agent. In Runs 1 and 5 where only water was used with hydrothermally treated lignite, the moisture content of the slurry averaged 52.7 wt. % whereas in Runs 2, 3 and 4 using hydrothermally treated lignite and a surface active agent, the moisture content of the slurry averaged 44.8 wt. %, a reduction of 15%.

A comparison of the data in Examples II and III shows that there is slight improvement over a solid fuel-water slurry if a surface active agent or if hydrothermally treated fuel is used but there is a distinct improvement when both hydrothermally treated fuel and a surface active agent are used.

Various modifications of the invention as hereinbefore set forth may be made without departing from the spirit and scope thereof, and therefore, only such limitations should be made as are indicated in the appended claims.

We claim:

1. A process for the preparation of a pumpable solid fuel-water slurry having a solids content measured on a dry basis of between about 50 and 60% by weight said solid fuel having a particle size such that at least 70% passes through a 200 mesh sieve which comprises subjecting finely-divided solid fuel selected from the group consisting of sub-bituminous coal and lignite to a hydrothermal treatment by forming a mixture of finely-divided solid fuel and water, heating the mixture to a temperature between about 300 and 700° F. under a pressure sufficient to maintain water in the liquid phase for a period of time between 1 minute and 2 hours under non-oxidizing conditions, separating the solid fuel from the water used to form said mixture and adding to said hydrothermally treated fuel having a particle size such that at least 70% passes through a 200 mesh sieve water in an amount to form a slurry containing about 50 to 60 wt. % solid fuel and also adding as a surface active agent a salt of an organic sulfonic acid in an amount to confer pumpability to said slurry.

2. The process of claim 1 in which the solid fuel is lignite.

3. The process of claim 1 in which the solid fuel is sub-bituminous coal.

4. The process of claim 1 in which the mixture is heated to a temperature between 400° and 600° F.

5. The process of claim 1 in which at least 70% of the finely-divided solid fuel passes through a 325 mesh sieve.

6. The process of claim 1 in which the solid fuel is separated from the water, partially dried and then formed into said slurry.

7. The process of claim 1 in which the surface-active agent is calcium lignin sulfonate.

8. The process of claim 1 in which the surface-active agent is sodium lignin sulfonate.

9. The process of claim 1 in which the surface-active agent is ammonium lignin sulfonate.

10. The process of claim 1 in which the surface-active agent is present in the slurry in an amount between about 0.01 and 3.0 wt. %.

11. The process of claim 1 in which the surface-active agent is present in the slurry in an amount between about 0.1 and 2.0 wt. %.

12. The process of claim 1 in which the hydrothermal treatment is effected by passing the mixture through an elongated tubular reaction zone under conditions of turbulent flow.

13. A process for the preparation of a pumpable solid fuel-water slurry having a solids content measured on a dry basis of between about 50 and 60% by weight which comprises grinding a solid fuel selected from the group consisting of sub-bituminous coal and lignite having a moisture content below about 20 wt. % so that at least 70 wt. % passes through a 200 mesh sieve, subjecting said ground solid fuel to a hydrothermal treatment by forming a mixture thereof with water, heating the mixture to a temperature between 400° and 600° F. under a pressure sufficient to maintain water in the liquid phase for a period of time between 1 minute and 2 hours under non-oxidizing conditions, separating said ground solid fuel from the water used to form said mixture and adding to said hydrothermally treated fuel, water in an amount to form a slurry containing from about 50 to 60 wt. % solid fuel and also adding as a surface-active agent a salt of organic sulfonic acid in an amount up to about 3% by weight of said slurry to confer pumpability thereto.

14. The process of claim 13 in which the surface-active agent is sodium lignin sulfonate.

15. The process of claim 13 in which the surface-active agent is calcium lignin sulfonate.

16. The process of claim 13 in which the hydrothermal treatment is effected by passing the mixture through an elongated tubular reaction zone under conditions of turbulent flow, in the presence of added hydrogen.

* * * * *